United States Patent [19]

Mizelle

[11] Patent Number: 4,858,258

[45] Date of Patent: Aug. 22, 1989

[54] MATTRESS AND SUPPORTING STRUCTURE THEREFOR

[76] Inventor: Ned W. Mizelle, P.O. Box 5985, High Point, N.C. 27262

[21] Appl. No.: 42,581

[22] Filed: Apr. 22, 1987

Related U.S. Application Data

[63] Continuation-in-part of Ser. No. 623,263, Jun. 21, 1984, abandoned.

[51] Int. Cl.[4] ..... A47C 19/12; A47C 17/04; A47C 27/00

[52] U.S. Cl. ..... 5/12 R; 5/13; 5/174; 5/448; 5/481; 5/464

[58] Field of Search ..... 5/12 R, 13, 448, 481, 5/464, 51, 250, 446, 201-205, 220, 224, 174, 475; 297/452, 454, 455

[56] References Cited

U.S. PATENT DOCUMENTS

| | | | |
|---|---|---|---|
| 238,107 | 2/1881 | Granger et al. | 5/202 |
| 250,814 | 12/1881 | Hood et al. | 5/203 |
| 315,998 | 4/1885 | Bedell | 5/203 |
| 416,679 | 12/1889 | Jones | 5/203 |
| 570,341 | 10/1896 | Sample | 5/202 |
| 571,821 | 11/1896 | Wood | 5/204 |
| 692,705 | 2/1902 | Plettenberg | 5/202 |
| 771,811 | 10/1904 | Collier | 5/201 |
| 892,566 | 7/1908 | Stevens | 5/204 |
| 1,130,946 | 3/1915 | Gelder | 5/448 |
| 1,183,367 | 5/1916 | Freedman | 5/202 |
| 1,639,422 | 8/1927 | Barna | 5/202 |
| 2,024,836 | 12/1935 | Sarenholm | 5/202 |
| 2,545,310 | 3/1951 | Rosberger | 5/448 |
| 2,702,392 | 2/1955 | Salzer | 5/201 |
| 2,712,137 | 7/1955 | Hunter | 5/201 |
| 2,738,975 | 3/1956 | Zaboy | 5/202 |
| 3,001,211 | 9/1961 | Goldenthal | 5/202 |
| 3,058,126 | 10/1962 | Fleming et al. . | |
| 3,813,710 | 6/1974 | Janko | 5/13 |
| 4,206,524 | 6/1980 | Cook | 5/481 |
| 4,207,635 | 6/1980 | Leroy | 5/446 |
| 4,236,260 | 12/1980 | Mizelle | 3/13 |
| 4,301,559 | 11/1981 | Geenberghe | 5/13 |
| 4,381,570 | 5/1983 | Schneider | 5/13 |
| 4,439,878 | 4/1984 | Stevens | 5/13 |

FOREIGN PATENT DOCUMENTS

| | | | |
|---|---|---|---|
| 111820 | 12/1928 | Austria | 5/202 |
| 496869 | 11/1950 | Belgium | 5/204 |
| 1170970 | 4/1957 | France | 5/448 |
| 1251145 | 3/1960 | France | 5/448 |
| 1379720 | 10/1964 | France | 5/448 |
| 166727 | 1/1934 | Switzerland | 5/51 R |
| 5284 | of 1883 | United Kingdom | 5/201 |
| 10426 | of 1886 | United Kingdom | 5/205 |
| 401831 | 11/1933 | United Kingdom | 5/201 |

*Primary Examiner*—Alexander Grosz
*Attorney, Agent, or Firm*—Beveridge, DeGrandi & Weilacher

[57] ABSTRACT

A mattress is positioned on a flexible deck which is supported by tension members connected to a frame. In a preferred embodiment, the frame is formed of concave side rails, a horizontal head rail, and a horizontal foot rail. The upper surface of the deck is longitudinally concave and transversely convex. The mattress is tapered so that its upper surface is transversely and longitudinally crowned to counteract any potential sagging effect when a person lies on the mattress.

6 Claims, 2 Drawing Sheets

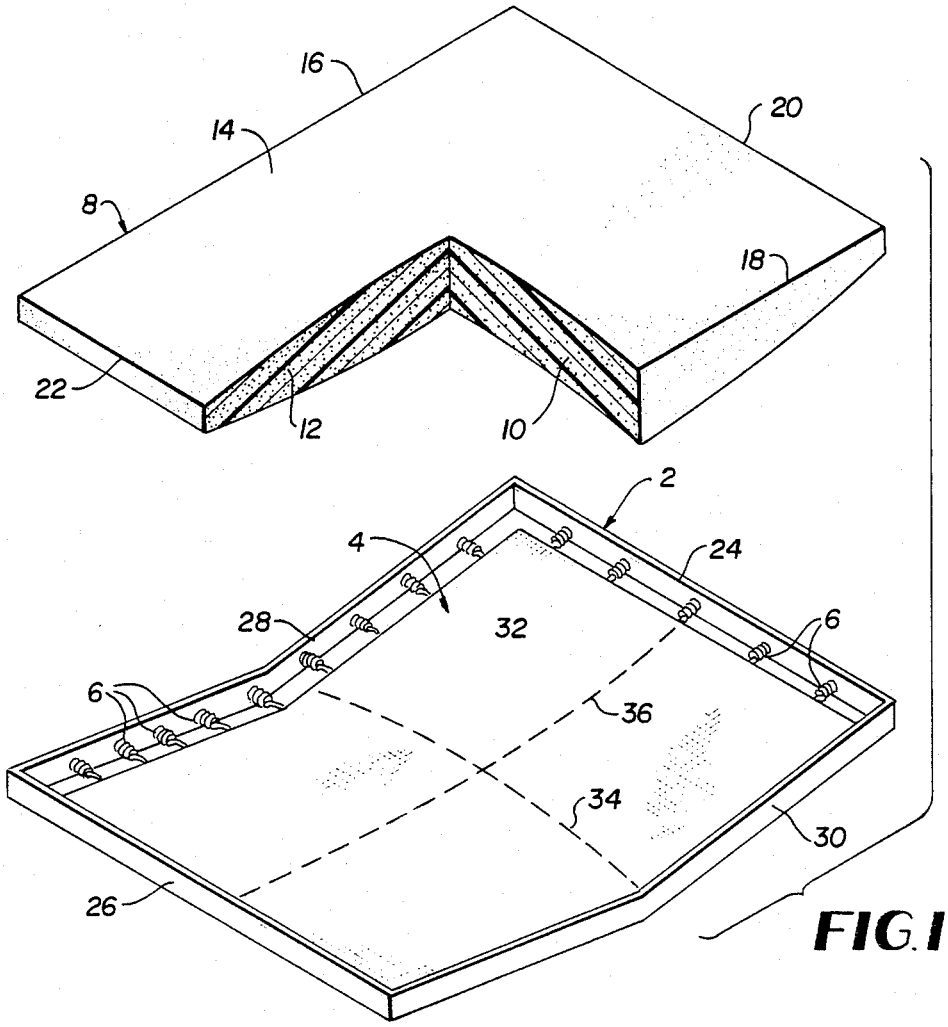
FIG. 1
FIG. 2
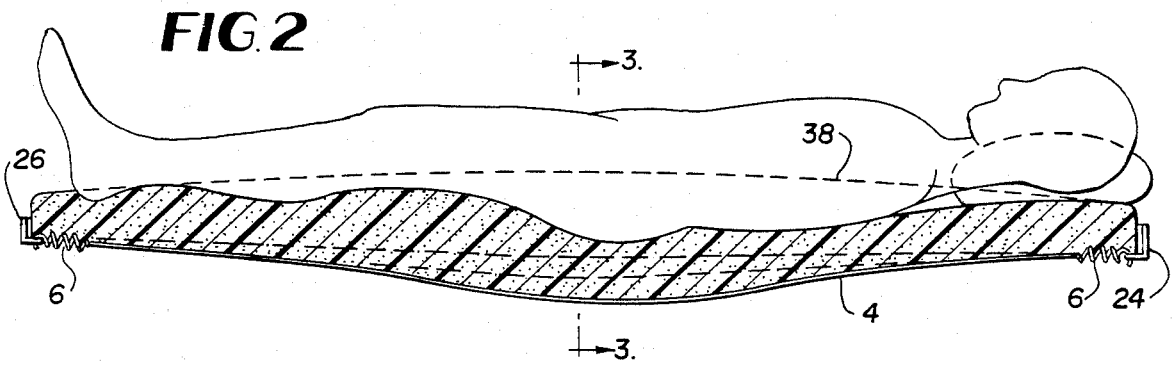
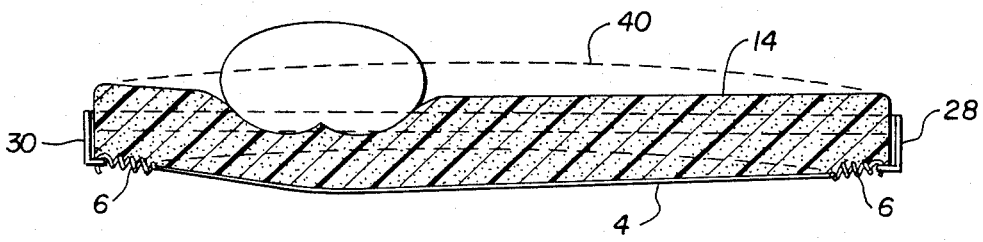
FIG. 3

MATTRESS AND SUPPORTING STRUCTURE THEREFOR

RELATED APPLICATION

This is a continuation-in-part of application Ser. No. 623,263 filed June 21, 1984, now abandoned.

BACKGROUND OF THE INVENTION

This invention relates to beds, and it particularly relates to improvements in mattress configurations and the decks and related structures for supporting mattresses.

The principal applicability of the invention is in storable bed structures such as sofa sleepers, rollaway beds, bunk beds and cabinet beds. Modern lifestyles often involve smaller homes, modest condominiums and apartments. This has created an increasing utilization of storable units that convert into beds. Previously, when such storable beds were used only for occasional guests, the comfort of such units was of secondary importance; however, as such units are now being used more frequently on a daily basis, the need for acceptable comfort levels is much greater.

A storable bed unit normally uses a thin mattress with flat upper and lower surfaces. The mattress is supported on a deck which has its perimeter connected to a foldable peripheral frame by means of helical springs or other tension elements. The decks are normally formed of a flexible metal mesh called "link fabric" or a textile fabric which has border wires sewn therein, an example of the latter being disclosed in my U.S. Pat. No. 4,326,260. Frames may be formed of tubular metallic sections, metal angles or a combination of such components.

A recognized problem of storable bed units is that they tend to sag or "hammock" to the center of the sleeping surface. This is particularly true in units where mattresses are very thin because they are required to fold into three thicknesses. The industry has recognized that there are glaring deficiencies in the sleeping comfort of such units, resulting in the rejection of such units at the retail level.

A number of solutions have been proposed to the sagging problem. One proposal is to increase the thickness of the mattress, but this introduces additional problems with respect to units such as sofa sleepers. The increased mattress thickness may raise the seating height to an unacceptable level. Due to the floor clearances required for the mechanisms of such units, thicker mattresses may require an increase in the front-to-rear depth of the unit to an extent which is aesthetically unacceptable.

Other efforts to avoid or diminish the sagging problem have involved an increase in the deck tension by adding tensioned wires, straps, rubber webbing or extra helical springs. It has also been proposed to modify the mattress structure so that it has areas of varying compressibility or density. These efforts add to the cost of such units and they have been used to some degree with limited results.

Another approach has been to provide the units with transverse wooden slats which are bowed upwardly. Beds of this nature have not been introduced in this country, at least to any significant extent, probably due to the increased cost of such construction. Another proposed but costly solution is to provide a deck which has a localized depression in the buttock area, and to provide a mattress with a localized protruberance on its lower surface for insertion in the depression.

It is believed that the present invention offers a superior solution to the sagging problem. It is superior in the sense that it does not increase significantly the cost of manufacture of the components of the system. In a sofa sleeper unit, the invention provides improved comfort during sleep while, at the same time, providing acceptable seat height, acceptable seat pitch, and acceptable travel clearances relative to the floor without significantly increasing the front-to-rear depth of the unit.

SUMMARY OF THE INVENTION

In one respect, the invention involves a mattress configuration wherein the mattress has an area of maximum thickness at a location which is spaced inwardly from its longitudinal edges or its transverse edges. The mattress has its minimum thickness at its perimeter, and a taper which extends from the area of maximum thickness to the area of minimum thickness. The upper surface of the mattress is generally smooth in the respect that it has no localized depressions and no localized protrusions for accommodating the anatomy of a person sleeping thereon.

In another respect, the invention relates to a mattress which has an upper surface of substantial convexity which extends substantially entirely across the mattress in a longitudinal and/or transverse direction when the lower surface of the mattress is located in a horizontal plane. The mattress is thinner near at least one pair of its edges than it is in its central area.

The invention involves, in a further respect, a deck for supporting the mattress. This deck has an upper mattress supporting surface which in transverse planes is convex and in longitudinal planes is concave.

There are a number of additional features which contribute to the desirability of the present invention. For example, the deck is preferably supported by tensioning members connected to a peripheral frame which has horizontal head and foot rails, and concave side rails which, acting through the tensioning members, provide the shape to the mattress supporting surface. As will be apparent from this specification, the terms "concave" and "convex" are used in a broad sense to encompass curved shapes and shapes which are formed of plural linear segments so that they are, in effect, bowed or bent inwardly or outwardly. The longitudinal concavity of the deck is greatest at the sides of its mattress supporting surface, and this concavity decreases progressively toward the center of the mattress supporting surface. In transverse planes, the concavity of the deck is greatest at a midportion of the deck and it decreases progressively toward the head and foot of the deck.

The frame is formed of sections which are pivotally connected together to permit the frame to be folded from a sleeping position to a collapsed position. The longitudinal tension in the deck is greater when the frame is in the sleeping position than when the frame is in the collapsed position, and this feature reduces the transverse convexity of the deck when the frame is in the collapsed position. Preferably, the lower surface of the mattress is convex in longitudinal planes and concave in transverse planes.

The foldable deck-supporting frame may be connected to and supported by an upholstered furniture frame.

As to the configuration of the mattress, its minimum thickness is preferably located at the head and foot, i.e. the transverse edges of the mattress. In each transverse plane through the mattress, the mattress is upwardly convex and its thickness is substantially constant. The mattress is tapered in longitudinal vertical planes, but not in the transverse vertical planes. When the mattress is positioned on the deck, the upper surface of the mattress preferably has a convex curvature extending both longitudinally and transversely of the mattress.

The invention also pertains to various combinations of specified mattress configurations, deck configurations, foldable deck-supporting frames, and upholstered sofa frames.

BRIEF DESCRIPTION OF THE DRAWINGS

FIG. 1 is a somewhat diagrammatic exploded view of a preferred form of the invention, showing a mattress with a quadrant thereof removed for illustrative purposes, and the supporting deck and frame for the mattress.

FIG. 2 is a longitudinal sectional view through the mattress, showing its configuration in a condition of use.

FIG. 3 is a transverse sectional view as seen along the line 3—3 in FIG. 2.

FIGS. 7 and 8 show in broken lines the storage positions of the mechanisms of FIGS. 5 and 6, respectively.

DESCRIPTION OF A PREFERRED EMBODIMENT

Figure 4:
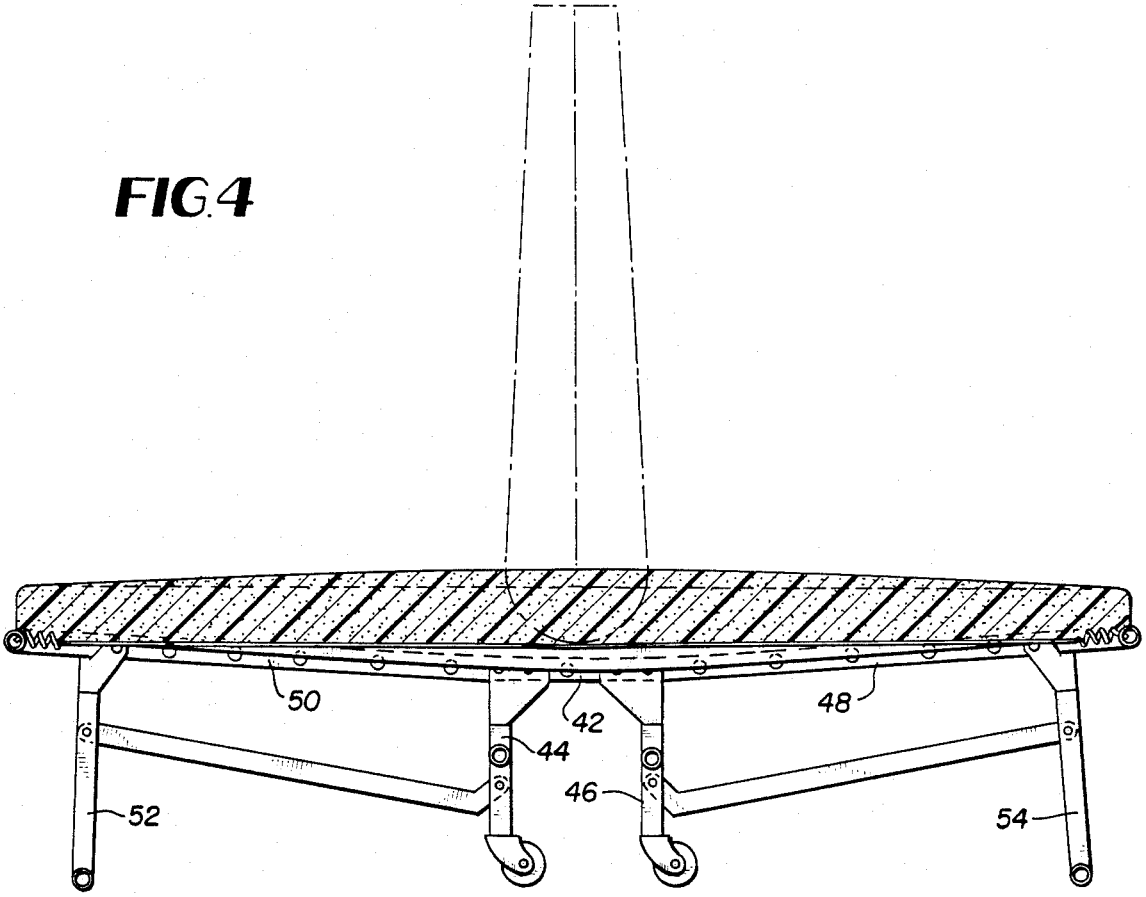
FIG. 4 shows a rollaway bed which utilizes the construction of the invention.

FIG. 1 shows a rectangular frame 2, a mattress-supporting flexible deck 4 which is connected to the frame by tension springs 6, and a mattress 8 which is normally supported on the deck 4. To illustrate the mattress configuration, a quadrant thereof is broken away to show transverse and longitudinal sections 10 and 12 of the mattress.

The upper surface 14 of the mattress 8 has a convex curvature which extends entirely across the mattress, both in transverse and longitudinal vertical planes. The center of the upper surface 14 is at least about $\frac{3}{4}$ inch higher than the edges of the upper surface. This upper surface 14 is smooth in the respect that it has no localized depressions and no localized protrusions for accommodating the anatomy of a person sleeping thereon. The smooth upper surface 14 may be quilted in a known manner to provide an ornamental pattern in relief and intaglio. The mattress is rectangular, and its perimeter is defined by a pair of longitudinal side edges 16 and 18 and a pair of transverse edges 20 and 22 which are located at the head and foot of the mattress.

In FIG. 1, the mattress has the shape it assumes when supported on the deck 4. When the mattress is supported on a flat surface so that its lower surface conforms to and is in a horizontal plane, its upper surface has a substantial convexity which extends substantially entirely across the mattress in a longitudinal direction. When it is supported on a flat horizontal surface, the mattress has no transverse convexity. The mattress is thinner near its head and foot than it is in the central area which is spaced inwardly from the longitudinal and transverse edges of the mattress.

In the embodiment of FIG. 1, the maximum thickness of the mattress is located approximately midway between the head and foot. The areas of minimum thickness are at the head and foot of the mattress. As shown by the longitudinal sectional surface 12, a taper extends from the area of maximum thickness to the area of minimum thickness. The area which represents the cross section of greatest thickness is, in the transverse plane of section 10, untapered and upwardly convex. The lower surface of the mattress conforms to the configuration of the mattress supporting surface of the deck. The lower surface of the mattress is concave in transverse planes so that the section 10 has a substantially constant thickness. In longitudinal planes, the lower surface of the mattress is convex. The maximum transverse concavity and the minimum longitudinal convexity are seen in the respective sections 10 and 12 in FIG. 1. The transverse concavity of the lower surface decreases progressively from the section 10 toward the head and toward the foot of the mattress. The longitudinal convexity of the lower surface increases progressively from the section 12 toward the side edges of the mattress.

The mattress is supported on the deck 4 which, as mentioned above, is supported by tension members 6 which are connected to the frame 2 which extends around the deck. The deck 4 is formed of a textile fabric, metal link fabric, or any other suitable material. The frame 2 has a horizontal head rail 24, a horizontal foot rail 26, and upwardly concave side rails 28 and 30. The frame 2 is preferably foldable for convenience of storage.

The forces exerted on the deck by the tension members 6 provide the shape to the upper mattress-supporting surface 32 of the deck. In transverse planes, the mattress supporting surface of the deck is convex: whereas, in longitudinal planes, the mattress supporting surface of the deck is concave. The maximum transverse concavity of the deck is greatest at the midportion of the deck as shown by the broken line 34. This transverse concavity decreases progressively toward the head and foot of the deck. The longitudinal concavity of the deck is greatest at the sides of the mattress supporting surface 32. This concavity decreases progressively toward the center of the mattress supporting surface. The location of the minimum longitudinal concavity is at the line 36 shown in FIG. 1.

From the foregoing, it will be understood that the springs 6 provide connecting means on the frame for subjecting the flexible deck to substantially horizontal tensile forces in longitudinal and transverse directions. This gives the concavity and convexity to the mattress supporting surface of the deck when there is no vertical load on the deck. The substantially horizontal tensile forces which act in transverse directions are disposed along lines which are concave and lie in vertical longitudinal planes on opposite sides of the deck.

FIGS. 2 and 3 illustrate the manner in which the invention improves the characteristic of the bed. In these drawings, the broken lines 38 and 40 represent the initial unloaded position of the upper surface of the mattress, whereas the broken lines 39 and 41 show the initial unloaded positions of the desk and lower surface of the mattress. The upper surface is convex so that it is crowned both in the longitudinal section shown in FIG. 2 and the transverse section shown in FIG. 3. When a person lies on the bed, the deck and the mattress deform to the positions shown in solid lines. In FIG. 2, it will be noted that the buttocks area is located in the vicinity of the maximum thickness of the mattress which naturally provides a greater cushioning effect. Further, the upper surface 14, rather than sagging, becomes somewhat horizontal when loaded.

In FIG. 3, the occupant is shown in a position which is offset to one side from the longitudinal centerline of the mattress. Nonetheless, the upper surface 14 of the mattress is generally horizontal so there is no significant tendency for the upper surface to sag to a point that the occupant will tend to roll toward the longitudinal centerline of the mattress.

The invention is suited for use in connection with a wide variety of bedding frames. For example, FIG. 4 shows a rollaway bed in which the side rails are formed of three pivotally interconnected sections. The midsection 42 is substantially horizontal and is supported on a pair of legs 44 and 46 which are provided with casters. Extending forwardly and rearwardly from the midsection are the side rail sections 48 and 50 which are supported on legs 52 and 54 when the bed is in the sleeping position shown in FIG. 4. These forward and rearward side rail sections 48 and 50 are inclined slightly upwardly toward the head and foot of the bed, thereby providing the concave configuration which has essentially the same effect as the frame illustrated in FIG. 1. The mattress 8 is folded to the elevated storage position in a conventional manner by swinging the side rail sections 48 and 50 upwardly on pivots 49 and 51 until the mattress arrives at the position shown in broken lines.

Figure 5:
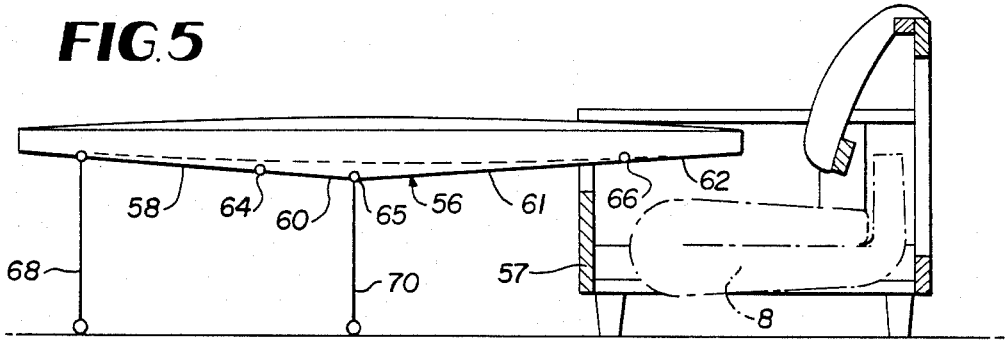
FIGS. 5 and 6 show two different types of sofa sleepers to which the invention is applicable.
Figure 6:
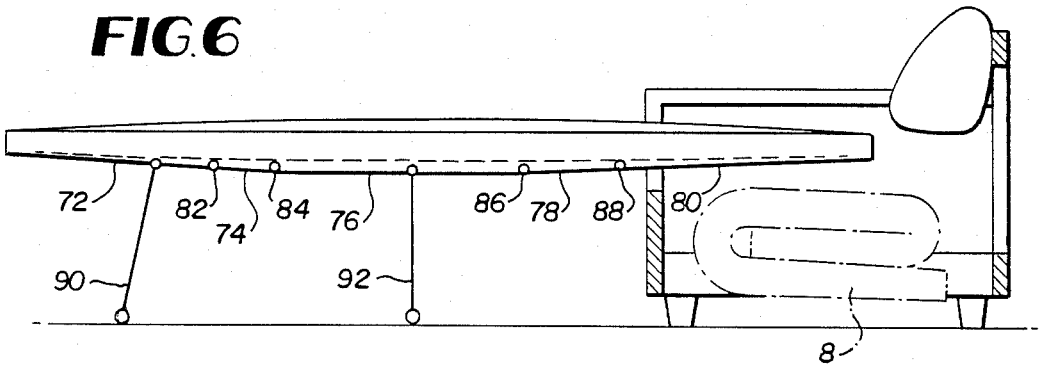

In each of the embodiments shown in FIGS. 5 and 6, a foldable frame is connected to an upholstered sofa frame, and the side rail of the foldable frame comprises a plurality of pivotally interconnected sections which permit the frame to be folded from a sleeping position to a collapsed storage position. When in the collapsed position, the frame occupies a storage position where it is housed in the furniture frame. When extended, the foldable frame occupies a generally horizontal sleeping position where it extends from the furniture frame.

The frame 56 shown diagrammatically in FIG. 5 is supported by links which are connected to the upholstered sofa frame 57. One such link is schematically illustrated by a broken line 59. The side rails in this embodiment are formed of four sections 58, 60, 61 and 62 which are pivotally connected to each other at the pivots 64, 65 and 66. Auxiliary support legs 68 and 70 have their upper ends pivotally connected to the side rails. In a conventional manner, the frame is folded by folding the side rail sections to a collapsed position where they form a cavity for storing the mattress. The folded mattress 8 occupies the position in the furniture frame which is shown in broken lines. In this position, the mattress is folded into three sections, one of which is generally vertical, and two of which are generally horizontal. The folded configuration of the frame components around the mattress is shown in FIG. 7. It will be noted that the tapered configuration of the mattress provides its upper surface with a slight rearward pitch. When loose seating cushions are placed on the folded mattress, the sofa sleeper has the appearance and comfort of a conventional sofa.

The sofa sleeper shown in FIG. 6 uses a somewhat different frame and storage principle than the one shown in FIG. 5. In FIG. 6, the broken line 71 indicates diagrammatically that the deck supporting frame is connected to the upholstered sofa frame. The side rail sections 72,74, 76, 78 and 80 are pivotally connected together at pivot points 82, 84, 86 and 88. The auxiliary support legs 90 and 92 have their upper ends pivotally connected to the side rails. The articulated side rail makes it possible to fold the frame and a mattress therewithin to the position shown in broken lines in FIG. 6, where the mattress is in three generally horizontal sections. The folded configuration of the frame components around the mattress is shown in FIG. 8. In this arrangement, loose, tight or semi-attached back cushions are provided. Conventional seating cushions are placed on the folded mattress to provide a comfortable and attractive article of furniture.

To avoid excessive transverse convexity which would be detrimental to the appearance of the sofa when the mattress is stored therein, the frames shown in FIGS. 5 and 6 are arranged so that the deck supported thereby will have more longitudinal tension when the frame is in the sleeping position that when it is in the collapsed storage position. Due to this arrangement, the transverse convexity is reduced when the frame is in the collapsed position.

The mattresses used in connection with the invention will generally be of conventional length and width ranging from a size of about 27×48 inches to a size of 84×84 inches. The maximum and minimum thicknesses of the mattresses will be about $8\frac{1}{2}$ inches and $1\frac{3}{4}$ inches, respectively. The mattress may be of innerspring or foam construction, and it may be made by existing technology. In a foam mattress, the crowned or tapered shape is due to the initial thickness of the foam before the mattress cover is applied. In the case of an innerspring mattress, the desired shape may be a result of the height of the rows of spring coils and/or the initial thickness of the filler materials before the cover is applied.

The preferred versions of the invention have been illustrated, but it should be kept in mind that alternative arrangements are contemplated within the scope of the broader claims which are presented below. For example, in one possible modification, the mattress supporting surface of the deck may be horizontal in all transverse planes, and concave in all longitudinal planes. The concave configuration may be a shallow Vee. The mattress in this arrangement will have an upper surface which is planar, a lower surface which conforms to the deck, and a thickness which has its maximum at or near the mattress transverse centerline. The principal advantage of this construction is that the mattress will be thicker in the buttocks area. This particular deck configuration is not possible when using a shaped support frame and a tensioned deck.

Another unillustrated modification utilizes a planar deck which may be supported by perimetrical tension members connected to a perimetrical frame. The mattress has its maximum thickness at or near its transverse centerline, and it tapers to a minimum thickness which is at the head and foot of the mattress. This construction is comfortable in the center, but it is less comfortable toward the sides of the bed because of the excessive thickness near the sides of the mattress.

Still another configuration utilizes a planar deck which is supported by perimetrical tension members and a perimetrical frame. This differs from the previous embodiment in that the mattress of this version tapers both in longitudinal and transverse directions from a point of maximum thickness which is located at or near the intersection of the transverse and longitudinal centerlines of the mattress. This arrangement is comfortable for sleeping purposes but, it looks relatively thin and it is not as cost efficient from a manufacturing standpoint as the mattress shown in FIG. 1.

The mattress may be of foam or innerspring construction. It can be of one piece construction as shown, or it can be formed of two or more pieces which are stacked to form the claimed configuration.

Various linkages, well known in the furniture industry, may be used to control the movements of the sections of the foldable frames disclosed in this specification. Examples are disclosed in U.S. Pat. No. 4,301,559 issued Nov. 24, 1981 and U.S. Pat. No. 4,439,878 issued Apr. 3, 1984. A more recent but referred linkage is disclosed in U.S. Pat. No. 4,592,102 issued June 3, 1986. The disclosures of these three patents are incorporated herein by reference.

Rather than using helical springs to tension the deck, it is possible to use elastomeric members or inelastic means such as eye bolts or tangs which connect the frame to the perimeter of the deck. The deck may be a fabric of woven stretch oriented members which is shrunk by heating after it is connected to the frame.

Persons familiar with the art will recognize that this significant invention may take many forms. Therefore, it is emphasized that the scope of the invention is not limited to the disclosed embodiments but is embracing of a wide variety of structures which fall within the spirit of the following claims.

I claim:

1. A sleeping unit, comprising, a flexible deck for supporting a mattress, said deck having a perimeter comprising two sides, a head and a foot, said deck having an upper mattress supporting surface which in transverse planes is convex and in longitudinal planes is concave, said longitudinal concavity being greatest at the sides of the mattress supporting surface and decreasing progressively toward the center of the mattress supporting surface, said transverse convexity being greatest in a midportion of the deck and decreasing progressively toward the head and foot of the deck, said mattress supporting surface having a longitudinal centerline which is concave, a foldable frame which surrounds the perimeter of said deck, said frame having a horizontal head rail, a horizontal foot rail and two side rails; connecting means of the frame for subjecting the flexible deck to substantially horizontal tensile forces in longitudinal and transverse directions to give the mattress supporting surface its said concavity and convexity when there is no vertical load on the deck, said substantially horizontal tensile forces in transverse directions being disposed along lines which are concave and lie in vertical longitudinal planes on opposite sides of the deck, a mattress having a perimeter comprising a pair of longitudinal edges and a pair of transverse edges, said mattress having an upper surface which is generally smooth in the respect that it has no localized depressions and no localized protrusions for accommodating the anatomy of a person sleeping thereon, said mattress having an area of maximum thickness at a location which is spaced inwardly from said transverse edges and is positioned over said longitudinal centerline to provide an enhanced cushioning effect, said perimeter including an area of minimum thickness of the mattress, said mattress having a taper which extends from said area of maximum thickness to said area of minimum thickness, said mattress having a lower surface which is supported on and conforms to the mattress supporting surface of the deck.

2. A sleeping unit according to claim 1 wherein an upholstered furniture frame is connected to said foldable frame, said foldable frame being movable from a storage position where it is folded and housed in said furniture frame to an unfolded sleeping position where it extends from the furniture frame.

3. A sleeping unit according to claim 1 wherein said frame is movable between a folded seating position and an unfolded sleeping position, said deck being subjected to more longitudinal tension when the frame is in its unfolded sleeping position than when the frame is in its folded seating position, said deck having less transverse convexity when the frame is in said folded seating position than when the frame is in said unfolded sleeping position.

4. A sleeping unit according to claim 1 wherein said mattress has an upper surface which is convex in transverse and longitudinal planes.

5. A sleeping unit according to claim 1 wherein the mattress is movable with the frame to a folded storage position where the mattress is folded into three sections, disposed where one said section is generally vertical and two said sections are generally horizontal.

6. A sleeping unit according to claim 1 wherein the mattress is movable with the frame to a folded storage position where the mattress is folded into three generally horizontal sections.

* * * * *